United States Patent [19]

Dwyer

[11] Patent Number: 4,790,728

[45] Date of Patent: Dec. 13, 1988

[54] DUAL-RIGID-HOLLOW-STEM ACTUATORS IN OPPOSITE-PHASE SLURRY PUMP DRIVE HAVING VARIABLE PUMPING SPEED AND FORCE

[76] Inventor: Anthony F. Dwyer, 10 Windsor Road, Finchley, London N3, England

[21] Appl. No.: 801,531

[22] Filed: Nov. 25, 1985

[30] Foreign Application Priority Data

Feb. 12, 1985 [GB] United Kingdom ..... 8503501

[51] Int. Cl.[4] ..... F04B 15/02; F04B 9/10; F15B 13/06

[52] U.S. Cl. ..... 417/342; 417/517; 417/900; 92/110; 60/369; 60/374; 60/381; 91/523

[58] Field of Search ..... 92/110, 113; 91/14, 91/32, 178, 189 R, 513, 519, 520, 523, 283, 286, 346, 347; 60/374, 381, , 383, 426, 446, 369; 417/515, 516, 517, 900, 338, 339, 340, 342, 347

[56] References Cited

U.S. PATENT DOCUMENTS

| | | | |
|---|---|---|---|
| 1,667,138 | 4/1928 | Barks | 91/346 X |
| 1,910,019 | 5/1933 | Kelly | 91/346 X |
| 2,596,471 | 5/1952 | Densmore et al. | 91/178 X |
| 3,106,257 | 10/1963 | Helm | 92/113 X |
| 3,205,906 | 9/1965 | Wilkinson et al. | 417/900 X |
| 3,335,642 | 8/1967 | Rosaen | 92/110 |
| 3,353,352 | 11/1967 | Gardner | 92/110 X |
| 3,507,347 | 4/1970 | Bennett | 417/900 X |
| 3,635,125 | 1/1972 | Rosen et al. | 91/346 X |
| 3,667,869 | 6/1972 | Schlecht | 417/900 X |
| 3,682,575 | 8/1972 | Guddal et al. | 417/517 |
| 3,744,375 | 7/1973 | Kubik | 92/110 X |
| 3,774,696 | 11/1973 | Horsch | 92/520 X |
| 3,959,967 | 6/1976 | Chardonneau et al. | 60/382 |
| 4,241,641 | 12/1980 | Reinert | 91/520 X |
| 4,611,973 | 9/1986 | Birdwell | 417/347 X |

FOREIGN PATENT DOCUMENTS

| | | | |
|---|---|---|---|
| 0085521 | 8/1983 | European Pat. Off. . | |
| 1653478 | 3/1971 | Fed. Rep. of Germany . | |
| 1653415 | 9/1971 | Fed. Rep. of Germany . | |
| 3243738 | 5/1984 | Fed. Rep. of Germany | 417/900 |
| 185881 | 10/1984 | Japan | 417/517 |

*Primary Examiner*—Robert E. Garrett
*Assistant Examiner*—George Kapsalas
*Attorney, Agent, or Firm*—Flynn, Thiel, Boutell & Tanis

[57] ABSTRACT

A slurry pump has slurry hopper and dual pumping cylinders. The slurry pumping members are driven by opposite-phase actuators. Each actuator has a rigid-hollow-stem partition dividing the space between the actuator plunger and the cylinder into two drive chambers of different areas selectively supplied with pressurized fluid to drive the plunger with a selected force and speed. An associated valve shuts off flow to one of the drive chambers and is controlled at any given time to occupy the same position as a corresponding valve of the other actuator. The valves coordinate supply of fluid to corresponding drive chambers on alternate strokes of two actuators.

6 Claims, 4 Drawing Sheets

DUAL-RIGID-HOLLOW-STEM ACTUATORS IN OPPOSITE-PHASE SLURRY PUMP DRIVE HAVING VARIABLE PUMPING SPEED AND FORCE

BACKGROUND OF THE INVENTION

The present invention relates to reciprocatory pumps having a reciprocable pumping member or members driven by a hydraulic or pneumatic actuator.

FIELD OF THE INVENTION

The present applicant's U.S. Pat. No. 4 569 642 describes such a pump which is intended for pumping concrete or other types of slurry into a pipeline, from a hopper. Two pumping pistons in respective cylinders are driven with opposite phases to alternately draw slurry from the hopper and force it along the pipeline. The pistons are driven by respective hydraulic actuators which comprise double-acting pistons slidable in cylinders.

SUMMARY OF THE INVENTION

The present invention provides a pump having a reciprocable pumping member driven by an actuator which comprises a cylinder and a plunger slidable in and closing the cylinder, wherein the space between the plunger and cylinder is partitioned to form a plurality of closed drive chambers, the plunger being slidable with respect to the cylinder along the cylinder to vary the volumes of the drive chambers, and the pump further comprising means operable to supply pressurised fluid to selectable ones of the drive chambers.

The ability to select the drive chambers to which hydraulic pressure is supplied enables the pressure at which material is pumped to be selected while the hydraulic pressure supplied to the actuators remains constant. This is not possible in the known pump described above, and consequently that pump cannot pump any particular material through more than a fixed maximum height. The maximum height through which a material may be pumped by a pump embodying the present invention can be changed by changing the selection of chambers supplied with pressurized fluid. Accompanying a change in the selection, there is a change in the pumping speed. Thus, when the pump is required to pump to a greater height, a high pumping pressure can be selected (with correspondingly reduced delivery flow) whereas when pumping to a lower height is required, a lower pumping pressure can be selected so as to increase the pumping speed and delivery flow. Regardless of these changes, the means supplying hydraulic fluid to the actuators can be operated to supply constant power at their most efficient setting.

A temporary increase in pumping pressure may be used if material is being pumped through a pipeline and the pipeline becomes blocked. The sudden increase in pumping pressure which is obtained by changing the selection of drive chambers in use may be sufficient to clear the blockage, thereby avoiding the need to turn off the pump and manually find and clear the blockage.

BRIEF DESCRIPTION OF THE DRAWINGS

An embodiment of the invention will now be described by way of example with reference to the accompanying drawings in which.

DESCRIPTION OF THE PREFERRED EMBODIMENT

Figure 1:
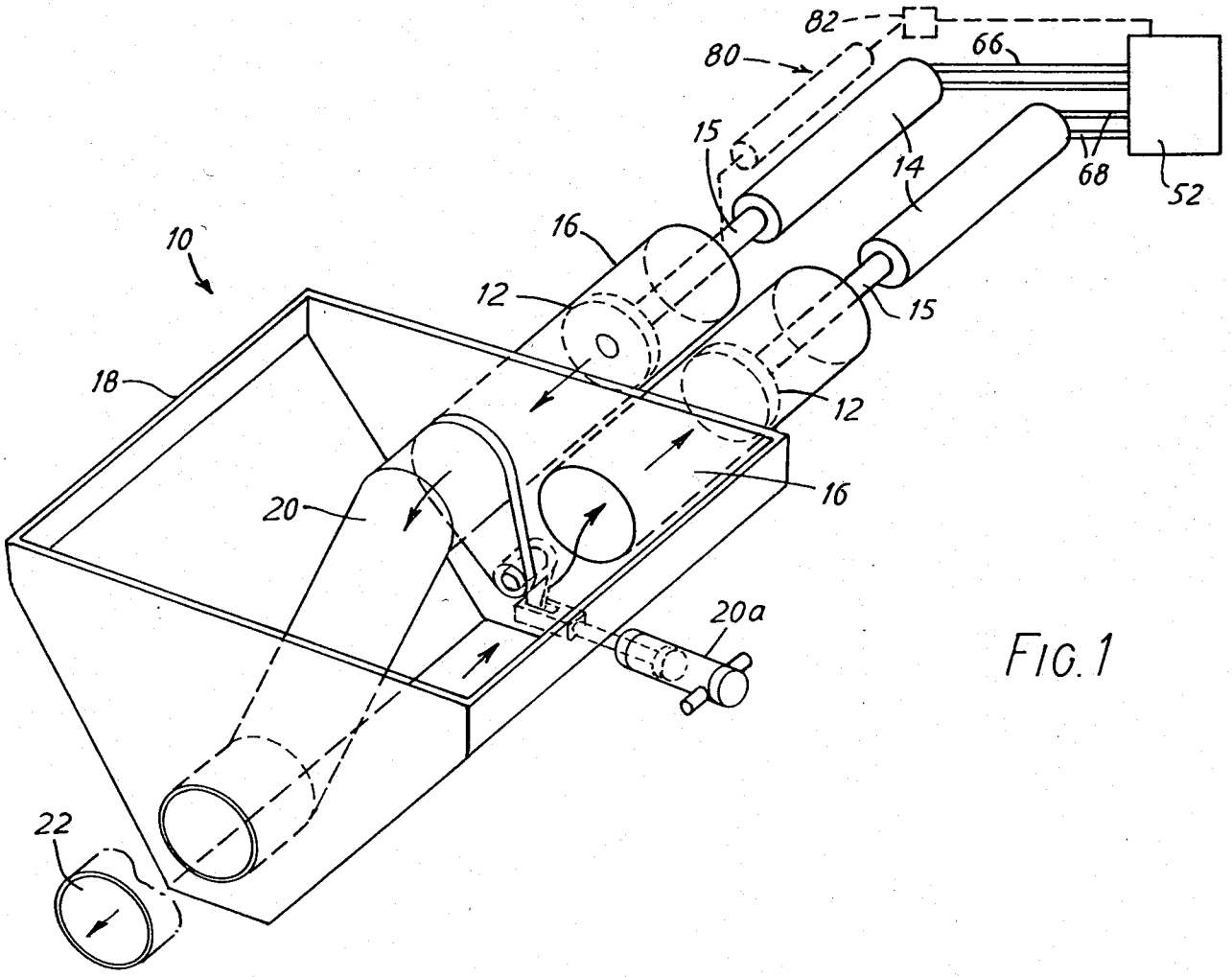
FIG. 1 is a schematic perspective view of the pump.

FIG. 1 shows a slurry pump 10 having two reciprocable pumping pistons 12 driven by respective hydraulic actuators 14. The pistons 12 are reciprocated in respective pumping cylinders 16 which are in communication with the interior of a hopper 18 filled with slurry to be pumped. The pistons 12 are reciprocated with opposite phases, so that during each half of the pumping cycle, slurry is drawn into one cylinder 16 and expelled from the other. Slurry expelled from a cylinder 16 is forced along a delivery tube 20 and along a delivery pipe line 22. The delivery tube 20 is pivotally mounted at its lower end and its upper end is swung into and out of communication with the cylinders 16 alternately, so as to be always in communication with the cylinder 16 which is expelling slurry. The delivery tube 20 is swung by means of a hydraulic actuator 20*a* comprising double-acting pistons in one or two cylinders. Only one cylinder is shown. A second may be desirable to supplement the swinging force applied to the tube 20, for instance when the tube 20 is large, so that a large force is needed to move the tube through the slurry.

Figure 2:
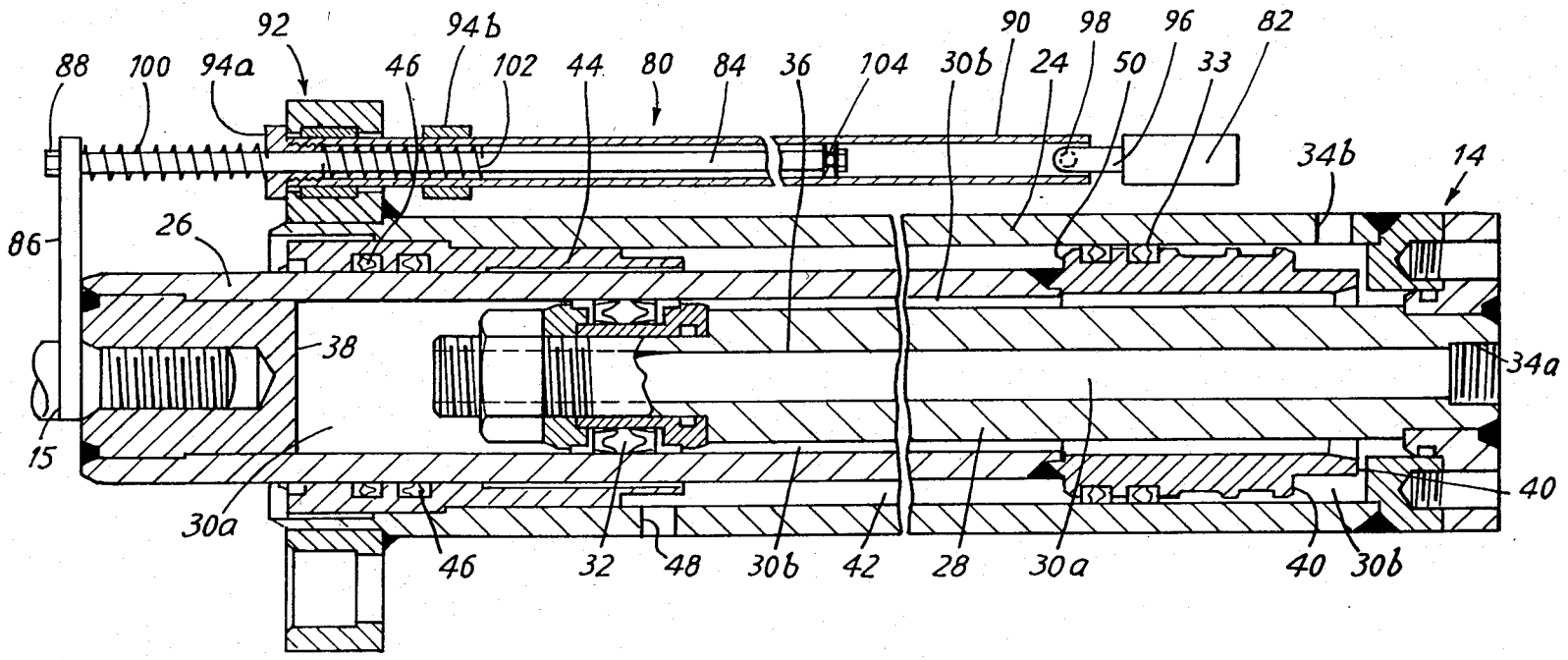
FIG. 2 is an axial sectional view of an actuator driving one of the pumping members of the pump of FIG. 1.

The structure of each actuator 14 is shown in FIG. 2. Each actuator 14 comprises a cylinder 24 and a plunger 26 slidable in and closing the cylinder. The plunger 26 is connected to the corresponding piston 12 by a drive rod 15. The position of the cylinder is fixed in relation to the hopper 18.

The chamber between the plunger 26 and the cylinder 24 is partitioned by a hollow cylindrical partition 28 coaxial with the cylinder 24, to define two closed drive chambers 30*a*, 30*b*. Sliding movement of the plunger 26 in the cylinder 24 varies the volumes of the chambers 30*a*, 30*b*. Composite annular seals 32, 33 located in grooves in the partition 28 and the plunger 26 respectively provide sliding seals between the partition 28 and the plunger 26, and between the plunger 26 and the cylinder 24.

Hydraulic fluid is selectively supplied under pressure to the chambers 30*a*, 30*b* through supply ports 34*a*, 34*b*. Hydraulic fluid supplied through the port 34*a* passes along the bore 36 of the partition 28 to act on the face 38 of the plunger 26 and urges the plunger 26 along the axis of the cylinder 24 to the left as seen in FIG. 2.

Hydraulic pressure supplied through the port 34*b* acts on the annular faces 40 of the plunger, and also urges the plunger to the left as seen in FIG. 2.

The actuator 14 further comprises an annular return chamber 42, between the plunger 26 and the cylinder 24. The return chamber 42 is sealed from the drive chamber 30*b* by the seal 33 around the plunger 26. A collar 44 is fixed to the cylinder 24, and has grooves in which further seals 46 are located to seal the return chamber 42 from the outside of the cylinder 24. Each actuator has a supply port 48 communicating with its return chamber 42. The supply ports 48, and hence the return chambers 42 are interconnected by a pipeline 76. When the plunger 26 of one actuator 14 is being extended, fluid is driven out of the return chamber 42 of that actuator and into the return chamber 42 of the other actuator 14 where it acts on a shoulder 50 on the plunger 26 to drive the plunger to the fully retracted position shown in FIG. 2. Accordingly, the plungers move with opposite phases.

FIG. 2 also shows a linkage 80 provided between the plunger 26 of one of the actuators and a spool valve 82. The function of the spool valve 82 is to control the reciprocation of the plungers 26 as will be described later.

The linkage 80 comprises a steel rod 84 attached to a yoke 86 by a nut 88. The yoke is attached to the drive rod 15, so that the yoke 86 and the rod 84 move with the plunger 26. The rod 84 travels inside a tube 90 which is slidable in a mounting 92. Movement of the tube 90 in the mounting 92 is limited by stops **94*a*, 94*b* mounted on the tube 90. The end of the tube 90 away from the mounting 92 is attached to the operating spool 96 of the valve 82 by a shear pin 98**.

Two short springs 100, 102 are located around the rod 84, between the stop **94*a* (which extends a short way into the tube 90) and the yoke 86, and between the stop 94*a* and a nut 104 on the free end of the rod 84**.

The linkage 80 operates in the following manner. When the plunger 26 is moving away from the retracted position shown in FIG. 2, the rod 84 moves with it, towards, the left of that figure. Eventually, near the end of the stroke, the nut 104 makes contact with the spring 102, which transmits a force to the stop **94*a* to move the tube 90, and hence the spool 96, until the stop 94*b* abuts the mounting 92. A catch within the valve 82 holds the spool in this position. Ideally, the stop 94*b* abuts the mounting 92 at the end of the plunger stroke, but any overrun is taken up by the spring 102. On the return stroke of the plunger, the rod 84 is retracted into the tube 90 until the yoke 86 bears on the spring 100. The spring 100 pushes on the stop 94*a* to move the tube 90 in the mounting 92 until the stop 94*a* abuts the mounting 92. This movement returns the spool 96 to its original position where it is retained by the catch. The spring 100 absorbs any overrun of the plunger 26** during this phase of its movement.

Figure 3:
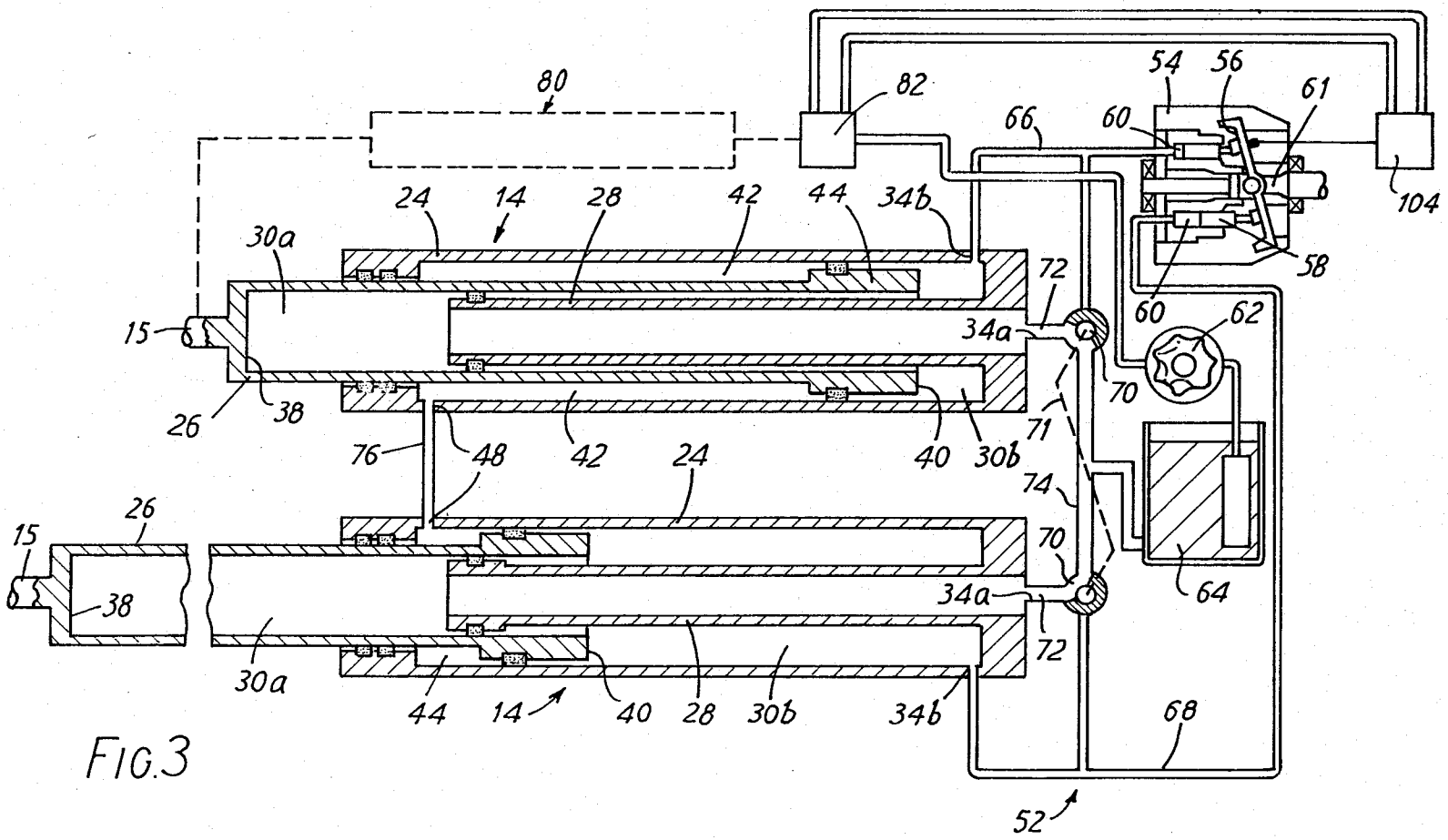
FIG. 3 is a diagram showing both actuators of the pump of FIG. 1, connected to the associated hydraulic circuit in the condition arranged for low pressure pumping.

FIG. 3 shows both actuators 14 and the circuit 52 for supplying hydraulic fluid to them. The Figure is schematic for reasons of clarity. In particular, the linkage 80 is shown simply, in broken lines. The circuit 52 comprises a swash plate pump 54 driven by a diesel engine (not shown). The pump 54 has a swash plate 56 which causes pistons 58 to reciprocate in a ring of cylinders 60 (only two of which are shown). The swash plate is driven by a rotating shaft 61 and the direction in which fluid is pumped between the pipes 66, 68 can be reversed by rocking the swash plate 56 on the end of the shaft 61. Reversal of the swash plate 56 is effected by an actuator 104 to which pressurised fluid is supplied under the control of the valve 82, from a small pump 62. The pump 62 draws fluid from a sump 64.

The pumping delivery can be varied by changing the angle of the swash plate 56 relative to its rotation axis, thereby varying the stroke length of the pistons 58, or by changing the throttle setting of the engine driving the pump 54. The engine is set to run at a speed to generate maximum power, and the volume delivered by the pump 54 is set by the angle of the swash plate 56. Thereafter, the swash plate position remains the same except for reversal by the actuator 104.

The pipe 66 and the pipe 68 are both branched and connect the pump 54 to the supply ports **34*b* of the drive chambers 30*b* of respective actuators 14, and to one port of a respective three-way valve 70. A pipe 72 connects a second port of each valve 70 to the supply ports 34*a* of the drive chamber 30*a* of one of the actuators 14. A pipe 74 connects the third ports of the valves 70 to the sump 64. A further pipe 76 connects the return chambers 42 of the actuators 14**.

The valves 70 have two positions. In the first position, shown in FIG. 3, they connect the piping 72 to the piping 74. Thus the chambers **30*a* of both actuators 14 are vented to the sump 64, while the pump 54 pumps fluid from the drive chamber 30*b* of one actuator 14 to the equivalent drive chamber 30*b* of the other actuator 14**.

Figure 4:
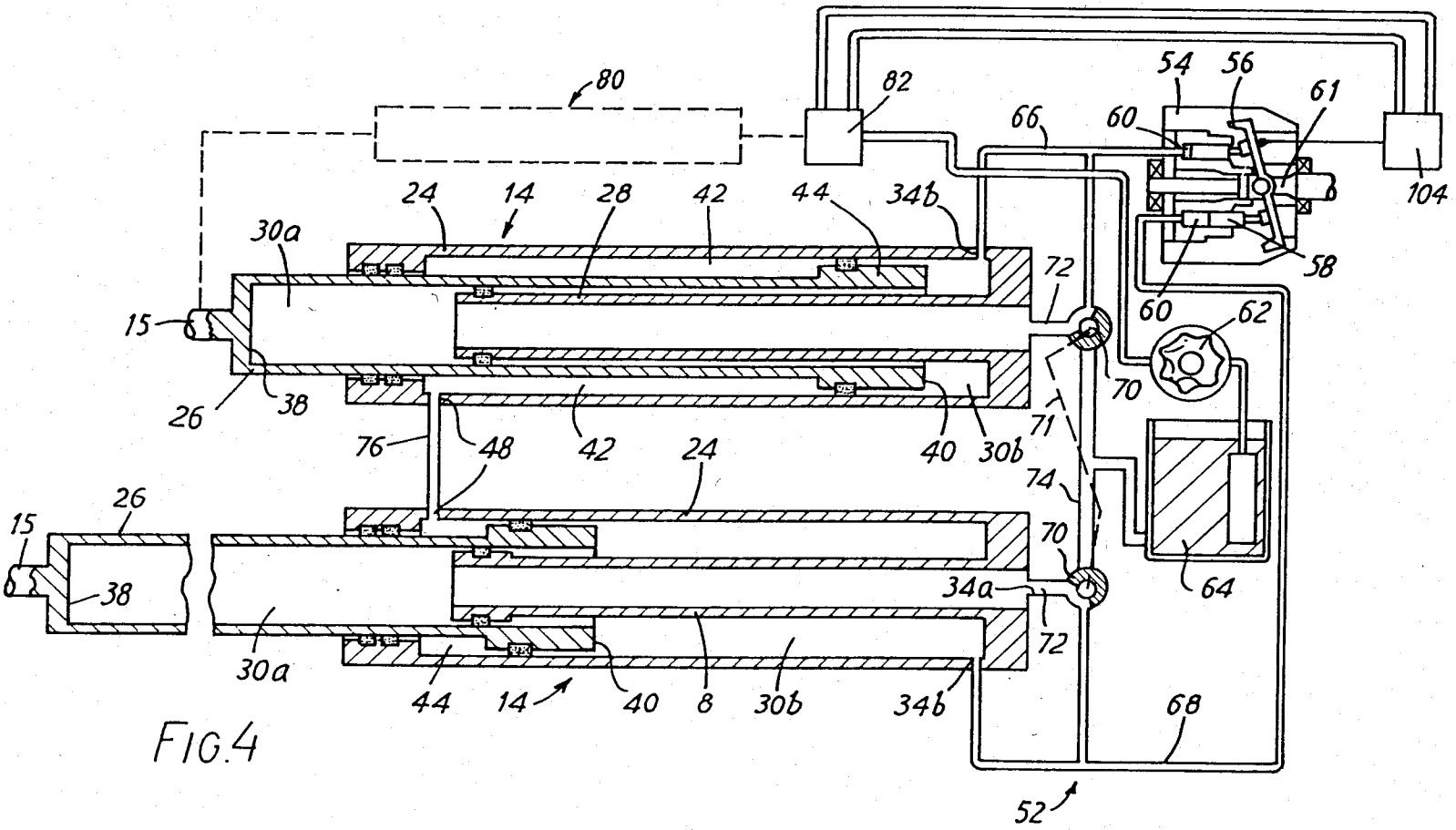
FIG. 4 is a diagram like FIG. 3, but in the condition for high pressure pumping.

In the second position, shown in FIG. 4, the pipes 66, 68 are connected to the corresponding pipes 72. The pump now supplies hydraulic fluid to both drive chambers **30*a*, 30*b* of one of the actuators by pumping from the chambers 30*a*, 30*b* of the other actuator 14**.

The valves 70 are provided by two single or one double selector valve controlled by a single, manually operated control indicated at 71.

When the slurry pump 10 is in use, the operator sets the positions of the valves 70 together, by operating the control 71. When the valves 70 are in the positions shown in FIG. 3, and with the actuators in the positions shown there, hydraulic pressure acts on the face 40 of the plunger 26 in the actuator shown at the top of the figure. The plunger of the upper actuator 14 is driven to the left, and as it moves, hydraulic fluid is expelled from the return chamber 42 of the upper actuator 14. The expelled fluid passes along the pipe 76 and enters the return chamber 42 of the lower actuator 14, to retract the plunger of the lower actuator from the extended position shown.

Fluid continues to pass in this way until the plunger of the lower actuator is fully retracted and the plunger of the upper actuator is fully extended. At this point, the valve 82 controlling the swash plate moves to its other position, and so reverses the swash plate angle. The direction in which the pump 54 is pumping, and the directions of movement of the plungers then reverse.

The plungers are driven with a smaller force by comparison with the situation to be described with reference to FIG. 4 when the valves 70 are in the position shown in FIG. 3, because hydraulic pressure bears on the faces 40, but not on the faces 38. In order to fully extend a plunger, only the chamber **30*b* is filled, so that only a relatively small volume of fluid must be provided by the pump 54. Consequently, the plungers move quickly, and for a fixed setting of the pump 54 and the diesel engine driving the pump 54, the situation shown in FIG. 3 results in the pump 10 pumping slurry with a relatively low pumping force, but at a relatively high rate. When the valves 70 are in the positions shown in FIG. 4, hydraulic fluid acts on the faces 38 as well as acting on the faces 40. For the same setting of the pump 54 and of the engine driving it, that is, for the same fluid supply pressure, the plunger 26 is driven with a greater force than when the valves 70 are in the positions shown in FIG. 3. However the volume of fluid which must be pumped in order fully to extend the plunger is also increased because both drive chambers 30*a*, 30*b* are filled. The plungers move more slowly in comparison with the arrangement of FIG. 3**. Accordingly, the arrangement of FIG. 4 operates the pump 10 to pump with a larger pumping force but at a slower rate.

In the arrangement of FIG. 4, as in the arrangement of FIG. 3, one plunger 26 is driven out until it is fully extended, whereupon the pumping direction of the pump 54 is reversed, to extend the other plunger 26. As each plunger extends, it expels fluid from the corresponding return chamber 42 into the other return chamber 42 to retract the other plunger 26.

The output of the pump 62 may be used additionally for topping up the hydraulic system (including the return chambers) in the event of leakages.

I claim:

1. A pumping apparatus, comprising:

means defining first and second variable-volume pumping chambers;

first and second pumping members reciprocable within the first and second pumping chambers, respectively, to vary the volumes thereof, the pumping chambers each having an inlet for the introduction of material to be pumped and an outlet for the delivery of material from the pumping chamber;

first and second actuator means coupled to the first and second pumping members, respectively, and operable to reciprocate the pumping members, said first and second actuator means driving said first and second pumping members with mutually opposite phases;

each of said actuator means comprising a cylinder having a cylinder bore therein, a plunger located within the cylinder, a tubular partition fixed with respect to the cylinder and arranged within the plunger, the partition cooperating with said plunger and said cylinder for defining first and second drive chambers which have different working areas, the plunger being slidable in the cylinder bore and with respect to the tubular partition to vary the volumes of said drive chambers, a pump for supplying pressure fluid, pump output selection means comprising first and second valve means arranged within conduit means between said pump and said first and second actuator means, respectively, each said valve means being operable to shut off flow of pressure fluid from said pump to one of said drive chambers of its associated actuator means to determine the pumping force transmitted to its associated pumping member, and valve control means for controlling operation of said first and second valve means so that both of said first and second valve means are in the same position at any given time and pressure fluid is supplied on alternate strokes to corresponding drive chambers in said first and second actuator means.

2. An apparatus according to claim 1, wherein said plunger and said cylinder of each of said actuator means defines a return chamber, wherein fluid pressure in one of said return chambers drives the corresponding one of said plungers with respect to the corresponding one of said cylinders so as to reduce the volumes of the drive chambers defined by said corresponding plunger and cylinder, and fluid passage means interconnecting said return chambers.

3. An apparatus according to claim 1 wherein each of said valve means has a plurality of positions, each position serving to connect said pump to one or both of said first and second drive chambers of its associated actuator means.

4. An apparatus according to claim 3, in which said partition defines a passage for the supply of pressure fluid to a said drive chamber, said passage interconnecting said bore and an external connection at a closed end of said cylinder.

5. A pump according to claim 1, wherein, in each of said actuator means, said cylinder has a closed end, said plunger has a tubular wall defining a plunger bore, and said tubular partition extends from said closed end of said cylinder into said plunger bore, first sealing means slidably sealing said plunger to said cylinder bore and second sealing means slidably sealing said tubular partition to said plunger bore.

6. A pumping apparatus according to claim 5, wherein said first drive chamber is defined by said plunger bore, said tubular partition and said second sealing means, said tubular partition bore being communicable with said selection means to allow pressure fluid to be supplied through said tubular partition bore to said first drive chamber, said plunger having a closed end at the end thereof remote from said closed end of said cylinder, and said second sealing drive chamber being defined by said first and second means, said plunger bore and said cylinder bore.

* * * * *